US005716769A

United States Patent [19]

Dickerson et al.

[11] Patent Number: 5,716,769

[45] Date of Patent: Feb. 10, 1998

[54] ELEMENTS CONTAINING BLUE TINTED HYDROPHILIC COLLOID LAYERS

[75] Inventors: Robert E. Dickerson, Hamlin; Rickey J. Seyler, Hilton, both of N.Y.

[73] Assignee: Eastman Kodak Company, Rochester, N.Y.

[21] Appl. No.: 812,634

[22] Filed: Mar. 7, 1997

[51] Int. Cl.[6] ..... G03C 1/79

[52] U.S. Cl. ..... 430/521; 430/517; 430/627; 430/966

[58] Field of Search ..... 430/517, 521, 430/966, 627, 639

[56] References Cited

U.S. PATENT DOCUMENTS

| | | | |
|---|---|---|---|
| 4,267,306 | 5/1981 | Davis et al. | 528/226 |
| 4,695,531 | 9/1987 | Delfino et al. | 430/513 |
| 4,804,719 | 2/1989 | Weaver et al. | 525/420 |
| 4,999,418 | 3/1991 | Krutak et al. | 528/272 |
| 5,292,627 | 3/1994 | Hershey et al. | 430/356 |
| 5,372,864 | 12/1994 | Weaver et al. | 428/36.92 |
| 5,384,377 | 1/1995 | Weaver et al. | 525/437 |

OTHER PUBLICATIONS

Research Disclosure, vol. 184, Aug. 1979, Item 18431, XII.

*Primary Examiner*—Hoa Van Le
*Attorney, Agent, or Firm*—Carl O. Thomas

[57] ABSTRACT

A radiographic element is disclosed having a transparent film support and hydrophilic colloid layers including at least one silver halide emulsion layer coated on the support. Upon viewing following imagewise exposure and processing, the radiographic element exhibits a transparent blue appearance in areas of minimum density, at least a portion of the blue appearance being attributable to the presence in one or more of the hydrophilic colloid layers of at least one ionic linear condensation polymer containing an anthraquinone dye chromophore.

10 Claims, No Drawings

ELEMENTS CONTAINING BLUE TINTED HYDROPHILIC COLLOID LAYERS

FIELD OF THE INVENTION

The invention relates to an element for recording an image pattern of X-radiation exposure. More specifically, the invention relates to radiographic elements containing at least one radiation-sensitive silver halide emulsion layer.

DEFINITION OF TERMS

The term "intensifying screen" is employed to indicate an element capable of absorbing an image pattern of X-radiation and emitting a corresponding image pattern of visible light.

The term "radiographic element" designates an element capable of forming a visible image corresponding to an image pattern of X-radiation. Radiographic elements include elements capable of producing a viewable image following exposure to an imagewise pattern of X-radiation, elements capable of producing a viewable image following exposure by an intensifying screen which has received an imagewise X-radiation exposure, duplicating elements that are designed to be exposed through an image bearing radiographic element, and elements that are exposed by a laser or other controlled light source to recreate a digitally stored radiographic image.

The terms "front" and "back" in referring to radiographic imaging are used to designate locations nearer to and farther from, respectively, the source of X-radiation than the support of the radiographic element.

The term "dual-coated" is used to indicate a radiographic element having emulsion layers coated on both the front and back sides of its support.

The terms "colder" and "warmer" in referring to image tone are used to mean CIELAB b* values measured at minimum density that are more negative or positive, respectively. The b* measurement technique is described by Billmeyer and Saltzman, *Principles of Color Technology*, 2nd. Ed., Wiley, New York, 1981, at Chapter 3. The b* values describe the yellowness vs. blueness of an image with more positive values indicating a tendency toward greater yellowness.

In referring to grains and emulsions containing two or more halides, the halides are named in order of ascending concentrations.

The terms "high bromide" and "high chloride" in referring to grains and emulsions indicates that bromide or chloride, respectively, is present in concentrations of greater than 50 mole percent, based on total silver.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "polyester ionomer" indicates a polyester that contains at least one ionic moiety.

The term "half peak absorption bandwidth" refers to the spectral range in nm over which a dye exhibits a level of absorption equal to at least half of its peak absorption ($\lambda_{max}$).

*Research Disclosure* is published by Kenneth Mason Publications, Ltd., Dudley House, 12 North St., Emsworth, Hampshire P010 7DQ, England.

BACKGROUND

Radiographic elements are commonly formed by coating hydrophilic colloid layers on one or both sides of a transparent film support. At least one of the hydrophilic colloid layers contains a radiation-sensitive silver halide emulsion that forms a latent image when imagewise exposed to X-radiation and/or light.

Upon subsequent processing in a developer and then a fixing solution, followed by rinsing and drying, a viewable silver image is created in the radiographic element. Radiographic elements are commonly "read" by placing a fully processed element on a light box, which transmits diffuse white light to and through the radiographic element for viewing. The viewer then sees the silver image in the film against a bright, backlit background.

In medical diagnostic imaging, which is by far the largest end use for radiographic elements, radiologists require a cold (i.e., blue-black) image tone. A cold image tone reduces eye strain and, by years of use, has become an aesthetic requirement for film acceptance and use by radiologists.

While adding toning agents to the emulsion layers is a known expedient for producing colder image tones, as illustrated by Hershey U.S. Pat. No. 5,292,627, a more generally used technique is to incorporate a blue dye in the transparent film support. This provides an overall blue tint to the film as it is being viewed and causes the developed silver image to appear colder. Typically anthraquinone dyes are incorporated in the support as blue tinting dyes. Such dyes are illustrated by *Research Disclosure*, Vol. 184, August 1979, Item 18431, XII. Film Supports. Anthraquinone dyes have been chosen for support incorporation, since they are thermally stable at the elevated temperatures at which polymeric (typically, polyester) films supports are formed. They do, however, suffer the disadvantage of sublimation from the support. This leads to loss of blue density in the support. Sublimation is also a disadvantage in manufacture in that the dye leaving the support deposits on the manufacturing machinery, requiring more frequent production shut downs for cleaning and maintenance.

Another disadvantage that has arisen is that differences in imaging applications and preferences by radiologists has led to the necessity of preparing otherwise identical radiographic elements on film supports that differ in density. This is a disadvantage in manufacture and distribution in that multiple types of film support must be prepared and carried in inventory to meet differing image tone demands by radiologists.

The modification of polyesters and polyamides by the incorporation of an anthraquinone dye chromophore is disclosed by Davis et al U.S. Pat. No. 4,267,306, Weaver et al U.S. Pat. No. 4,804,719, 5,372,864 and 5,384,377, and Krutak et al U.S. Pat. No. 4,999,418.

SUMMARY OF THE INVENTION

A radiographic element is disclosed comprised of a transparent film support having first and second major faces and hydrophilic colloid layers coated on at least one of the first and second major faces including at least one radiation-sensitive silver halide emulsion layer, wherein, upon viewing following imagewise exposure and processing, the radiographic element exhibits a transparent blue appearance in areas of minimum density, at least a portion of the blue appearance being attributable to the presence in one or more of the hydrophilic colloid layers of at least one ionic linear condensation polymer containing an anthraquinone dye chromophore.

The incorporation of a polymer containing an anthraquinone dye chromophore in one or more of the hydrophilic colloid layers offers several practical advantages. First, the problem of dye sublimation that occurs when it is attempted to incorporate an anthraquinone dye in a transparent film support is avoided. Second, it is possible to employ a single transparent film support to construct radiographic elements having different degrees of blue tinting, merely by altering the coating coverage of the polymer containing the anthraquinone dye chromophore. Thus, the necessity of maintaining an inventory of supports differing in their blue tinting can be eliminated. Additionally, the incorporation of the anthraquinone chromophore in an ionic linear condensation polymer allows the polymer to be placed directly within an existing hydrophilic colloid of the radiographic element, thereby avoiding any necessity of coating a separate layer solely for the purpose of providing blue tinting. Still further the anthraquinone dye chromophore offers the advantage of remaining unaltered, even though present in a layer of the radiographic element that is permeated by aqueous alkaline and acid processing solutons.

DESCRIPTION OF PREFERRED EMBODIMENTS

Radiographic elements satisfying the requirements of the invention can be constructed in either a single-sided or dual-coated format, as shown below:

| Element I |
|---|
| Front Hydrophilic Colloid Layer Unit (FHCLU) |
| Transparent Film Support (S) |
| Back Hydrophilic Colloid Layer Unit (BHCLU) |
| Element II |
| Hydrophilic Colloid Layer Unit (HCLU) |
| Transparent Film Support (S) |
| Pelloid (P) |

The transparent film support S is transparent to radiation employed for imagewise exposure of the film. Additionally, the film support is transparent in the visible region of the spectrum to permit transmission of diffuse light from a light box through the element during viewing following exposure and processing.

Although it is possible for the transparent film support to consist of a flexible transparent film, the usual construction is as follows:

| |
|---|
| Surface Modifying Layer Unit (SMLU) |
| Transparent Film (TF) |
| Surface Modifying Layer Unit (SMLU) |

Since the transparent film TF is typically hydrophobic, it is conventional practice to provide surface modifying layer units SMLU to promote adhesion of the hydrophilic colloid layers to the front and back of the transparent film. Each surface modifying layer unit typically consists of a subbing layer overcoated with a thin, hardened hydrophilic colloid layer.

While any conventional transparent photographic or radiographic film support can be employed, the transparent film TF is preferably constructed of a polyester, to maximize dimensional integrity, rather than employing cellulose acetate supports as are most commonly employed in photographic elements.

The transparent film can be colorless or can be blue tinted. When the transparent film support is blue tinted, it is preferred to that the level of blue tint be limited to the minimum level required for the radiographic application to be served. For example, whereas currently a series of otherwise identical films are manufactured having film supports of differing levels of blue tinting to meet varied user preferences, in the practice of this invention, a single blue tinted film support can be employed that has the minimum blue tint required for the films in the otherwise identical series. Additional levels of blue tinting are provided in hydrophilic colloid layer units, as described below.

The transparent film supports, including incorporated blue dyes and surface modifying layers, are described in *Research Disclosure,* Item 18431, cited above, Section XII. Film Supports. *Research Disclosure,* Vol. 365, September 1996, Item 38957, Section XV. Supports, illustrates in paragraph (2) suitable surface modifying layer units, particularly the subbing layer components, to facilitate adhesion of hydrophilic colloids to the support. Although the types of transparent films set out in Section XV, paragraphs (4), (7) and (9) are contemplated, due to their superior dimensional stability, the transparent films preferred are polyester films, illustrated in Section XV, paragraph (8). Poly(ethylene terephthalate) and poly(ethylene naphthylate) are specifically preferred polyester film supports.

In the simplest contemplated form of the invention each of FHCLU, BHCLU and HCLU consists of a single radiation-sensitive silver halide emulsion layer. Preferably each of FHCLU, BHCLU and HCLU consists of the following sequence of layer units:

| |
|---|
| Protective Layer Unit (PLU) |
| Emulsion Layer Unit (ELU) |
| Underlying Layer Unit (ULU) |

where ULU is coated nearest the transparent film support S. ELU in most instances consists of a single radiation-sensitive silver halide emulsion layer, but can advantageously include two or more emulsion layers. For example, it is common practice to coat faster and slower emulsions in separate layers. It is also possible to reduce vehicle requirements by transferring a portion of the radiation-sensitive silver halide grains from ELU to ULU, thereby, in effect, converting ULU to an emulsion layer unit.

Except for the possible inclusion of an ionic linear condensation polymer, as discussed below, each of the layers of the hydrophilic colloid layer units can take any convenient conventional form. The following patents, here incorporated by reference, illustrate radiographic element constructions, which, except for lacking an ionic linear condensation polymer containing a dye chromophore, are within the contemplation of the invention:

| | |
|---|---|
| Dickerson | U.S. Pat. No. 4,414,304; |
| Abbott et al | U.S. Pat. No. 4,425,425; |
| Abbott et al | U.S. Pat. No. 4,425,426; |
| Dickerson | U.S. Pat. No. 4,520,098; |
| Daubendiek et al | U.S. Pat. No. 4,639,411; |
| Dickerson et al | U.S. Pat. No. 4,803,150; |
| Abbott et al | U.S. Pat. No. 4,865,958; |
| Dickerson et al | U.S. Pat. No. 4,900,652; |

-continued

| | |
|---|---|
| Dickerson et al | U.S. Pat. No. 4,994,355; |
| Dickerson et al | U.S. Pat. No. 4,997,750; |
| Bunch et al | U.S. Pat. No. 5,021,327; |
| Dickerson et al | U.S. Pat. No. 5,041,364; |
| Dickerson et al | U.S. Pat. No. 5,108,881; |
| Dickerson et al | U.S. Pat. No. 5,196,299; |
| Pruett et al | U.S. Pat. No. 5,215,876; |
| Dickerson et al | U.S. Pat. No. 5,252,442; |
| Dickerson | U.S. Pat. No. 5,252,443; |
| Hershey et al | U.S. Pat. No. 5,292,627; |
| Hershey et al | U.S. Pat. No. 5,292,631; |
| Hershey et al | U.S. Pat. No. 5,314,790; |
| Zietlow | U.S. Pat. No. 5,370,977; |
| Dickerson | U.S. Pat. No. 5,391,469; |
| Dickerson et al | U.S. Pat. No. 5,399,470; |
| Jones et al | U.S. Pat. No. 5,491,058; |
| Fenton et al | U.S. Pat. No. 5,567,580; and |
| Dickerson | U.S. Pat. No. 5,576,156. |

All of the layers of the radiographic elements, except as noted in connection with the support S, are hydrophilic colloid layers. They employ a hydrophilic colloid, typically gelatin or a gelatin derivative as a vehicle. Conventional vehicles and modifying components contemplated for use in the hydrophilic colloid layer units of the radiographic elements of the invention are disclosed in *Research Disclosure,* Item 38957, cited above, II. Vehicles, vehicle extenders, vehicle-like addenda and vehicle related addenda.

A more general description of PLU constructions and their components is provided by *Research Disclosure,* Item 18431, cited above, III. Antistatic Agents/Layers and IV. Overcoat Layers, and *Research Disclosure,* Item 38957, cited above, IX. Coating physical property modifying addenda, A. Coating aids, B. Plasticizers and lubricants, C. Antistats, and D. Matting agents. It is common practice to divide PLU into a surface overcoat and an interlayer. The interlayers are typically thin hydrophilic colloid layers that provide a separation between the emulsion and the surface overcoat addenda. It is quite common to locate surface overcoat addenda, particularly anti-matte particles, in the interlayer.

The underlying layer unit ULU provides a convenient location for processing solution decolorizable microcrystalline dyes that are optionally, but commonly used to reduce crossover in dual-coated Element I constructions. Preferred processing solution microcrystalline dyes are disclosed by Dickerson et al U.S. Pat. No. 4,803,150 and 4,900,652, cited and incorporated by reference above, and Diehl et al 4,940,654. It is possible to locate microcrystalline dyes in an emulsion layer, allowing ULU to be entirely eliminated. A preferred radiographic element construction is to place the microcrystalline dye in an emulsion layer coated nearest the support which is overcoated with a second, faster emulsion layer. In Element II constructions processing solution decolorizable microcrystalline dye can be incorporated in ULU to act as an antihalation dye. However, in Element II constructions the preferred location for antihalation dye is in the pelloid P.

The pelloid P in Element II is provided to offset physical forces exerted on the support by the emulsion and any other layers coated on the opposite side of the support, thereby protecting the element from any tendency toward curl. When the pelloid is constructed of a hydrophilic colloid vehicle, the pelloid is also an ideal location for processing solution decolorizable antihalation dye incorporation. The microcrystalline dyes set out by Dickerson et al and Diehl et al, cited in the preceding paragraph, can also be used as antihalation dyes. A general summarizing of processing solution decolorizable antihalation dyes is set out in *Research Disclosure,* Item 38957, cited above, VIII. Absorbing and scattering materials, B. Absorbing materials and C. Discharge. Since P is also a surface layer, it can also contain the various addenda described above in connection with PLU. Although preferred in most instances, the pelloid layer is not essential.

Although radiation-sensitive silver halide emulsions are generally useful in the radiographic elements of the invention and can take varied conventional forms, as illustrated *Research Disclosure,* Item 38957, cited above, I. Emulsion grains and their preparation, the preferred emulsions for incorporation in the radiographic elements of the invention are comprised of silver bromide optionally containing up to about 3 mole percent iodide, based on the total weight of silver. Preferred ELU constructions are those that include at least one tabular grain emulsion. The fastest attainable rates of processing are realized when high chloride tabular grain emulsions are employed.

Radiographic elements containing one or more tabular grain emulsions are particularly improved by the incorporation of linear condensation polymer containing anthraquinone dye chromophores, since it is generally appreciated that tabular grains produce progressively warmer image tones as the mean thickness of the tabular grains is decreased, whereas imaging performance is otherwise generally improved. Thus, the present invention specifically contemplates the use of tabular grain emulsions having mean grain thicknesses of less than 0.2 μm. Mean tabular grain thicknesses as low as 0.03 μm are known, but, to avoid undesirably warm image tones, mean tabular grain thicknesses of at least 0.1 μm are preferred.

The ionic linear condensation polymers containing an anthraquinone dye chromophore incorporated in one or more of the hydrophilic colloid layers of the radiographic elements can be formed by modifying the structure of a conventional linear condensation polymer. Linear condensation polymers are conventionally formed by reacting a Type I monomer having two reactive moieties of a first type (typically basic moieties) with a Type II monomer having two reactive moieties of a second type (typically acidic moieties), where the first and second type moieties are chosen to enter into a condensation reaction with each other. This can be illustrated as follows:

(III)

$$R^1—T^1—R^1+R^2—T^2—R^2=T^3—(T^1—L—T^2—L)_m—T^4$$

where $R^1—T^1—R^1$ is a Type I monomer, $R^2—T^2—R^2$ is a Type II monomer,

L is a linking group that results when $R^1$ and $R^2$ enter into a condensation reaction, m is an integer chosen to provide a desired molecular weight, and $T^3$ and $T^4$ are chain terminating groups.

When the $R^1$ reactive groups are hydroxy groups, $T^1$ preferably takes the form an alkyl group of from 1 to 6 carbon atoms. Thus, in a simple preferred form $R^1—T^1—R^1$ is a glycol, most preferably ethylene glycol. In a common variant form $T^1$ can contain from 2 to 12 carbon atoms and contain an internal oxy (—O—) ether linkage between carbon atoms. Alternatively, in forming polyamides, $R^1$ can take the form of a primary (—$NH_2$) or secondary amino (—$NHR^3$) group. $R^3$ is preferably alkyl of from 1 to 6 carbon atoms.

The $R^2$ reactive groups can be chosen from among carboxy groups [—C(O)OH]; carbonyl halide groups [—C (O)X, where X is a halide, typically chloride or bromide]; or ester groups [—OC(O)$R^4$, —OC(O)O$R^4$, OC(O)NH$R^4$, or —C(O)O$R^4$, where $R^4$ is alkyl, cycloalkyl or aryl, containing up to 10 carbon atoms]. Preferred ester groups are —C(O)O$R^4$ groups. Preferred $R^4$ alkyl groups contain from 1 to 6 carbon atoms. Preferred $R^4$ cycloalkyl groups are those containing from 3 to 8 ring carbon atoms, most preferably cyclopentyl and cyclohexyl groups. Preferred aryl groups are phenyl and naphthyl groups.

$T^2$ preferably takes the form of a phenylene or naphthylene group. Most commonly $R^2$—$T^2R^2$ is phthalic, terephthalic or isophthalic acid or an esterified derivative. Dearomatized (hydro) variants of phthalic and terephthalic acids are also conventionally employed in forming polyesters.

To allow the linear condensation polymer to be dispersed in a hydrophilic colloid vehicle present in the radiographic element it is necessary to modify at least a portion of the Type I or Type II repeating units making up the polymer so that they contain an ionic moiety. One approach for achieving this result is to substitute for a portion of the $R^2$—$T^2$—$R^2$ monomer a corresponding monomer containing an ionic substituent. When the linear condensation polymer is a polyester, a preferred form, addition of the ionic substituents converts the polyester to a polyester ionomer, a polyester formed by the condensation of ionic monomeric units. In a specifically preferred form of the invention the ionic linear condensation polymers employed in the radiographic elements of the invention are polyester ionomers.

A preferred ionic substituent is a sulfo group(—$SO_3^-M^+$). M can be any convenient counterion, such as hydrogen ($H^+$), alkali metal (e.g., $Li^+$, $Na^+$or $K^+$) or alkaline earth metal (e.g., $Mg^{++}$or $Ca^{++}$). Specifically referred sulfo-substituted repeating units are sulfo-substituted phthalic, terephthalic or isophthalic acid (and phthalic acid derivative) repeating units, particularly sulfo-substituted isophthalic acid or a derivative, such as one of the derivative forms discussed above—e.g. a carbonylhalide or ester form noted above. The sulfo group need not be a direct substituent of the diacid benzene ring, but can be attached through an intermediate linking group, taking a form such as sulfoalkyl, sulfoalkyloxy, sulfoaryl or sulfoaryloxy, where the alkyl moieties contain from 1 to 6 carbon atoms and the aryl moieties are preferably phenyl moieties.

As an alternative to a sulfo substituent, it is contemplated to employ a substituent containing a sulfoimino [—$SO_2$—$N^-(M^+)$—] moiety. The substituent can, for example, satisfy the formula:

(IV)

$$—SO_2—N^-(M^+)—(SO_2)_n—Y$$

wherein

M is as defined above, n is zero or 1, and

Y is alkyl of from 1 to 6 carbon atoms or aryl of from 6 to 12 carbon atoms, preferably phenyl.

It is also possible to incorporate disulfoimino moiety into the linear condensation polymer backbone by constructing the $R^2$—$T^2$—$R^2$ monomer described above to satisfy the formula:

(V)

$$R^3—C(O)Ar^1—SO_2—N^{-(M+)}—SO_2—Ar^2C(O)—R^3$$

wherein $R^3$ represents the atoms completing a carboxylic acid, carbonylhalide or ester moiety, as described above; and $Ar^1$ and $Ar^2$ are arylene moieties containing from 6 to 10 carbon atoms, preferably m or p-phenylene moieties.

Illustrations of linear condensation polymers generally and polyester ionomers in particular containing repeating pendant or backbone ionic moieties of the type described above are provided by Noonan et al U.S. Pat. No. 4,097,282, 4,252,921, 4,291,153, and 4,419,437 and Weaver et al et al U.S. Pat. No. 4,804,719, the disclosures of which are here incorporated by reference.

The incorporation of the ionic repeating units is adjusted as required to render the linear condensation polymer hydrophilic. Taking the sum of the terminal, basic (Type 1), and acidic (Type 2) groups forming the linear condensation polymer as 100 mole percent, the ionic repeating units can impart hydrophilic characteristics in concentrations of 1 mole percent or less. It is generally preferred that the ionic repeating units account for at least 5 mole percent of the polymer. By rendering the linear condensation polymer hydrophilic it can be acceptably mechanically blended with the hydrophilic colloid vehicle. As the proportion of the ionic repeating units in condensation polymer is increased the ease of obtaining a uniform distribution within the hydrophilic colloid vehicle is increased. No advantage has been identified for increasing the proportion of ionic repeating units beyond 40 mole percent of the condensation polymer. Generally convenient physical handling properties are observed in the ionic linear condensation polymer when overall molecular Weights are maintained in the range of from about 10,000 to 100,000.

The ionic linear condensation polymer additionally contains repeating units containing an anthraquinone dye chromophore to impart a blue tint to the radiographic element. In a simple form the polymer containing anthraquinone dye chromophore is blue. It is alternatively possible to blend polymers that are cyan and magenta to obtain an overall blue appearance. A blue appearance results from a relatively high transmission of blue (400 to 500 nm wavelength) light and a relatively low transmission (i.e., the absorption) of green (500 to 600 nm wavelength) and red (600 to 700 nm wavelength) light. When the dye chromophore incorporated within the polymer is chosen so that the polymer exhibits a half-peak absorption bandwidth that occupies a substantial portion of the red and green spectral regions, the polymer appears blue and can, if desired, be used alone. On the other hand, if the polymer has a half-peak absorption bandwidth that lies almost entirely in the green portion of the spectrum, it must be employed in combination with a polymer that exhibits a half-peak absorption bandwidth in or extending into the red region of the spectrum for the mixture to provide an overall blue appearance. It is generally preferred to choose anthraquinone dye chromophore containing polymers that have minimal absorption in the blue portion of the spectrum, since absorption in this spectral region increases minimum density without contributing to the desired blue appearance. Half-peak absorption bandwidths that extend beyond the red into the infrared have no detrimental effect, since the infrared region is not visible.

Anthraquinone

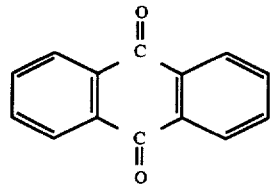

(VI)

is blue provides the basic chromophore of anthraquinone dyes. To incorporate an anthraquinone dye into the linear condensation polymer the anthroquinone structure is substituted to provide two reactive groups $R^1$ or two reactive groups $R^2$ of the type described above. The two reactive groups can be located at any synthetically convenient ring position and, also for synthetic convenience, are preferably linked to the ring positions through intervening linking groups. Both the location and choice of the linking groups can influence the half-peak absorption bandwidth of the resulting disubstituted anthroquinone. Condensation polymerization has little, if any, influence on the absorption of the dye. Additionally, the choices of other colorless components in the condensation polymer have essentially no influence on the hue of the final polymer, except to the extent that overall absorption is observed to decline by dilution as the proportion of colorless components is increased.

The anthraquinone dye can, if desired, contain other modifying substituents that do not interfere with the function of the reactive groups. Such groups can be used to influence the hue of the dye or modify physical properties, but such groups are preferably omitted, since reactive and linking group choices that fully satisfy invention requirements can be readily realized in the absence of additional substituents.

General descriptions of linear condensation polymers containing anthraquinone dye repeating units are provided by Davis et al U.S. Pat. No. 4,267,306 and Weaver et al U.S. Pat. Nos. 4,804,719, 5,372,719 and 5,384,377 and Kurtak et al U.S. Pat. No. 4,999,418, all cited above and here incorporated by reference. The anthroquinone repeating units disclosed in these patents that produce blue polymers are specifically contemplated to be incorporated in the ionic linear condensation polymers employed in the practice of this invention.

A preferred class of anthraquinone monomers useful in forming repeating units in the ionic linear condensation polymers are represented by the formula:

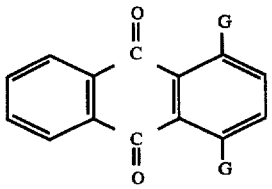

(VII)

where G is a reactive group $R^1$ or $R^2$, described above, which is preferably linked to the anthraquinone through a linking group. Synthetically convenient ring attachments of G that have preferred half-peak absorption bandwidths are realized when an amino nitrogen atom is bonded to the anthraquinone at its 1 and 4 ring positions. The amino nitrogen atom is then further substituted to provide a synthetically convenient linkage to the reactive group. For example, the amino nitrogen can be provided by an anilino group that is further substituted to provide a reactive group.

A specifically preferred class of anthraquinone dye chromophore containing monomers contemplated for incorporation in the ionic linear condensation polymers are those in which G satisfies the formula:

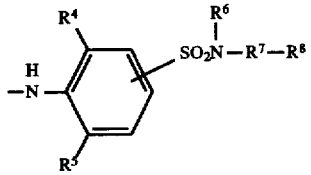

(VIII)

wherein $R^4$ and $R^5$ are independently selected alkyl groups containing from 1 to 6 carbon atoms, preferably methyl or ethyl groups;

$R^6$ is hydrogen or alkyl containing from 1 to 6 carbon atoms;

$R^7$ is alkylene containing from 1 to 6 carbon atoms, such as methylene, ethylene, iso-butylene or neo-pentylene; and $R^8$ is $R^1$ or $R^2$, most preferably $R^1$.

Another specifically preferred class of anthraquinone dye chromophore containing monomers contemplated for incorporation in the ionic linear condensation polymers are those in which G satisfies the formula:

(IX)

$$—NH—CH_2—C(R^9)(R^{10})—CH_2—R^8$$

wherein $R^9$ and $R^{10}$ are independently selected alkyl groups containing from 1 to 6 carbon atoms, preferably methyl or ethyl groups; and $R^8$ is $R^1$ or $R^2$ or an alkylene group of 1 to 6 carbon atoms or an arylene group of 6 to 10 carbon atoms that contains $R^1$ or $R^2$ as a substituent, preferably a terminal substituent. Linking groups of this type are disclosed by Kurtak et al U.S. Pat. No. 4,999,418, cited above and here incorporated by reference.

Based on the entire ionic linear condensation polymer amounting to 100 mole percent, the dye chromophore containing repeating units can account for from 1 molar part per million (mppm) up to the about 10 mole percent. The dye chromophore containing repeating units preferably account for at least 1 mole percent of the total polymer.

It is generally preferred that the ionic linear condensation polymer account for less than half the weight of the hydrophilic colloid layer or layers in which it is incorporated. A specific selection of the amount of condensation polymer to be incorporated is based on the blue tint desired in the radiographic element. The maximum amount of dye that can be tolerated is that which increases the overall neutral density of the radiographic element to up 0.25 (preferably 0.10) in minimum density areas following exposure and processing. Neutral density is determined from the specular transmission of white light through the radiographic element following imagewise exposure and processing. Any amount of condensation polymer can be employed which perceptibly increases the blue tint of the radiographic element. This can be measured as an increase in neutral density as little as 0.01. Preferably the condensation polymer is chosen to provide a neutral density of at least 0.10. When the support is itself clear and transparent, the neutral density in minimum density areas is determined entirely by the condensation polymer present.

It is generally preferred that the support exhibit a blue tint equal to the minimum blue tint desired for any imaging application a group of radiographic elements differing only in blue tint are intended to serve. Thus, the support can be clear (lacking blue tint) and transparent or can exhibit a significant blue tint (e.g., for many uses a minimal blue tint corresponds to a neutral density of at least 0.12). Elements in the group exhibiting higher degrees of blue tinting employ the same support, but incorporate a higher coating coverage of the ionic condensation polymer. Thus, a common amount of the ionic condensation polymer is that which increases neutral density in the range of from 0.12 to 0.25.

It is generally preferred to limit the neutral density in minimum density areas of fully processed radiographic element to 0.25 or less, since minimum densities above 0.25 are generally avoided.

EXAMPLES

The invention can be better appreciated by reference the following specific embodiments. Coating coverages, shown in parenthesis, are in units of $mg/dm^2$, unless otherwise indicated.

EXAMPLES 1–4

Radiographic Elements A–D

A series of radiographic elements were constructed by coating as described below on a clear, transparent polyester radiographic film support having a thickness of 177.8 μm.

ILCP Dye A

A ionic linear condensation polymer containing an anthraquinone dye chromophore was prepared as follows: Components (a)–(g) comprising (a) 157.5 g (0.95 m) isophthalic acid
(b) 55.8 g (0.22 m) 5-lithiosulfoisophthalate
(c) 106 g (1.0 m) diethylene glycol
(d) 80.5 g (0.56 m) 1,4-cyclohexane dimethanol
(e) 1.9 g (0.23 m) anhydrous sodium acetate
(f) 200 ppm Ti catalyst as titanium-tetraisopropoxide and,
(g) 35.0 g ($4.77\times10^{-2}$m) blue chromophore monomer, 1,4-bis[2-ethyl-x-(2-hydroxyethylsulfamoyl)-6-methylanilino]anthraquinone (an isomeric mixture in which x=3, 4 or 5), were added to a 1 L round bottom flask that was fitted with a stirrer, condensate take off, and nitrogen inlet head. The flask and contents were immersed into a salt bath and heated for two hours with stirring at about 230°–250° C., while esterification occurred. To carry out the polycondensation the temperature was increased to 250° C. and the flask was held under vacuum of ≦10 mm Hg for about 1 hour. .The resulting polymer was dark blue with a weight average equivalent molecular weight of 21000 and $T_g$=~53° C. This polymer contained about 10% by weight, based on total weight, dye chromophore, and was readily soluble in hot water, producing a dark blue aqueous solution;

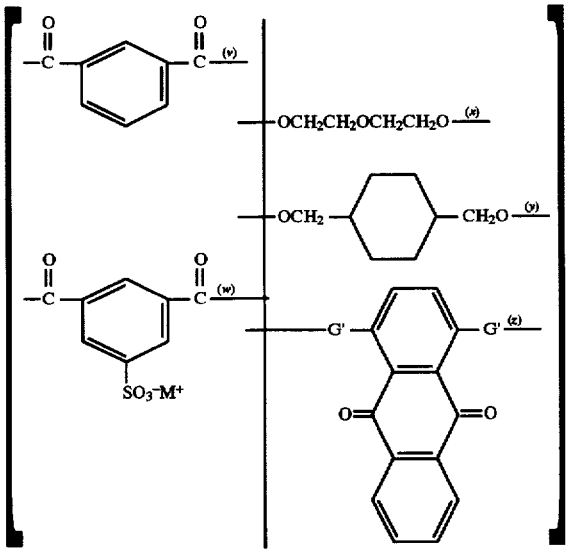

where

G' =

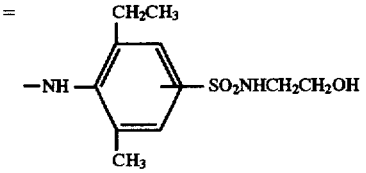

v=81 mole percent;
w=19 mole percent;
x=52 mole percent;
y=44 mole percent; and
z=4 mole percent.

Onto each major face of the support were coated the following layers, with the emulsion layer coated nearest the support:

| | |
|---|---|
| Surface Overcoat | |
| Gelatin | (3.4) |
| Methyl methacrylate anti-matte beads | (0.14) |
| Carboxymethyl casein | (0.57) |
| Colloidal silica | (0.57) |
| Polyacrylamide | (0.57) |
| Chrome alum | (0.025) |
| Resorcinol | (0.058) |
| Whale oil lubricant | (0.15) |
| Interlayer | |
| Gelatin | (3.4) |
| AgI Lippmann (based on Ag) (0.08 μm grains) | (0.11) |
| Carboxymethyl casein | (0.57) |
| Colloidal silica | (0.57) |
| Polyacrylamide | (0.57) |
| Chrome alum | (0.025) |
| Resorcinol | (0.058) |
| Nitron | (0.044) |
| Emulsion Layer | |
| AgBr tabular grains (based on Ag) (ECD 1.8 μm, thickness 0.13 μm) | (27.2) |
| Gelatin | (31.6) |
| ILCP Dye A | see Table I |
| 4-Hydroxy-6-methyl-1,3,3A,7-tetraazaindene | 2.1 g/Ag mole |
| Potassium nitrate | (1.8) |
| Ammonium hexachloropalladate | ($2.2\times10^{-3}$) |
| Maleic acid hydrazide | ($8.7\times10^{-3}$) |
| Sorbitol | (0.53) |
| Glycerin | (0.57) |
| Potassium Bromide | (0.14) |
| Resorcinol | (0.44) |
| Bis (vinylsulfonylmethyl) ether based on total gelatin per side | 2.5 wt. %, |

The AgBr tabular grains were sulfur and gold sensitized and spectrally sensitized with 400 mg/Ag mole of the green absorbing spectral sensitizing dye anhydro-5,5'-dichloro-9-ethyl-3,3'-bis(3-sulfopropyl)oxacarbocyanine hydroxide, by the addition of 300 mg/Ag mole of KI.

Processing

To observe the image tone of the films tested in minimum density areas, the films were processed without exposure in the a rapid access processor having the following processing cycle:

| | |
|---|---|
| Development | 27.6 seconds at 40° C. |
| Fixing | 18.3 seconds at 40° C. |
| Washing | 15.5 seconds at 40° C. |
| Drying | 21.0 seconds at 65° C. |
| The following developer was employed: | |
| Hydroquinone | 30 g |
| 4-Hydroxymethyl-4-methyl-1-phenyl-3-pyrazolidinone | 1.5 g |
| KOH | 21 g |
| $NaHCO_3$ | 7.5 g |
| $K_2SO_3$ | 44.2 g |
| $Na_2S_2O_5$ | 12.6 g |
| 5-Methylbenzotriazole | 0.06 g |
| Glutaraldehyde | 4.9 g |
| Water to 1 Liter (pH = 10) | |

Image Tone

The blue tint of Elements A through D is reported in Table I in terms of b* values measured at minimum density. The ability of the ionic linear condensation polymer containing anthraquinone dye chromophore, ILCP-A, to contribute to increasingly cold (more negative b*) element tones is demonstrated.

TABLE I

| Element | ILCP-A | b* |
|---|---|---|
| A | (6.6) | −11.2 |
| B | (8.8) | −14.9 |
| C | (10.9) | −18.5 |
| D | (13.1) | −21.9 |

EXAMPLES 5–7

Examples 1 through 4 were repeated, except that ILCP-A was coated at the coverage reported in Element A while blue tinted supports having differing neutral densities, as reported in Table II.

TABLE II

| Element | Support Density | b* |
|---|---|---|
| E | 0.19 | −17.2 |
| F | 0.18 | −16.3 |
| G | 0.16 | −15.6 |

By comparing Tables I and II it is apparent that the range of b* values obtained by varying only the coating coverage of the ionic linear condensation polymer ILCP-A compares favorably with variations in b* values obtained by differing levels of blue tinting in the support. It is therefore apparent that, instead of stocking a number of film supports differing in their blue tint, this invention allows reduction of alternatively tinted supports in stock. Further, the disadvantages of tinting the film support can be entirely avoided.

The invention has been described in detail with particular reference to preferred embodiments thereof, but it will be understood that variations and modifications can be effected within the spirit and scope of the invention.

What is claimed is:

1. A radiographic element comprised of a transparent film support having first and second major faces and hydrophilic colloid layers coated on at least one of the first and second major faces including at least one radiation-sensitive silver halide emulsion layer, WHEREIN, upon viewing following imagewise exposure and processing, the radiographic element exhibits a transparent blue appearance in areas of minimum density, at least a portion of the blue appearance being attributable to the presence in one or more of the hydrophilic colloid layers of at least one ionic linear condensation polymer containing an anthraquinone dye chromophore.

2. A radiographic element according to claim 1 wherein the transparent film support is clear and colorless.

3. A radiographic element according to claim 1 wherein the transparent film support is blue-tinted.

4. A radiographic element according to claim 1 wherein the radiographic element following imagewise exposure and processing exhibiting a neutral density in the range of from 0.12 to 0.25 in minimum density areas, with at least 0.01 of the neutral density provided by the linear condensation polymer.

5. A radiographic element according to claim 4 wherein the linear condensation polymer provides a neutral density of least 0.10.

6. A radiographic element according to claim 1 wherein the linear condensation polymer is a polyester.

7. A radiographic element according to claim 1 wherein the linear condensation polymer exhibits a molecular weight in the range of from 10,000 to 100,000.

8. A radiographic element according to claim 1 wherein the linear condensation polymer contains ionic repeating units.

9. A radiographic element according to claim 6 wherein the linear condensation polymer contains repeating units derived from a sulfo-substituted dicarboxylic acid.

10. A radiographic element according to claim 1 wherein the radiation-sensitive silver halide emulsion is a high bromide tabular grain emulsion containing less than 3 mole percent iodide, based on silver.

* * * * *